US009713379B1

(12) United States Patent
Tsai

(10) Patent No.: US 9,713,379 B1
(45) Date of Patent: Jul. 25, 2017

(54) SHELF SUPPORTING BEAM CONFIGURATION FOR SHELVING APPARATUS

(71) Applicant: Frank Tsai, Shenzhen (CN)

(72) Inventor: Frank Tsai, Shenzhen (CN)

( * ) Notice: Subject to any disclaimer, the term of this patent is extended or adjusted under 35 U.S.C. 154(b) by 0 days.

(21) Appl. No.: 15/047,651

(22) Filed: Feb. 19, 2016

Related U.S. Application Data

(63) Continuation-in-part of application No. 15/004,987, filed on Jan. 24, 2016.

(51) Int. Cl.

| | |
|---|---|
| ***A47B 57/00*** | (2006.01) |
| ***A47F 5/00*** | (2006.01) |
| ***A47B 47/00*** | (2006.01) |
| ***A47B 96/06*** | (2006.01) |
| ***A47B 57/50*** | (2006.01) |

(52) U.S. Cl.
CPC ..... *A47B 96/06* (2013.01); *A47B 47/00* (2013.01); *A47B 57/00* (2013.01); *A47B 57/50* (2013.01)

(58) Field of Classification Search
CPC ..... A47B 57/50; A47B 96/1441; A47B 96/06; A47B 47/0083; A47B 47/021; A47B 57/00; A47B 96/02; A47B 47/00
See application file for complete search history.

(56) References Cited

U.S. PATENT DOCUMENTS

| | | | | |
|---|---|---|---|---|
| 3,029,056 | A * | 4/1962 | Breglia | A47B 96/061 248/243 |
| 3,124,402 | A * | 3/1964 | Rhoads | A47B 88/12 211/162 |
| 3,199,683 | A * | 8/1965 | Graswich | A47B 57/425 108/109 |
| 3,523,612 | A * | 8/1970 | Hall | A47B 57/30 108/106 |
| 3,655,063 | A * | 4/1972 | Landry | A47F 5/0025 211/126.15 |
| 3,770,135 | A * | 11/1973 | Schild | A47F 5/103 108/108 |
| 3,862,691 | A * | 1/1975 | Mori | A47B 57/408 108/156 |
| 5,407,084 | A * | 4/1995 | Remmers | A47B 88/044 108/193 |
| 5,749,481 | A * | 5/1998 | Miller | A47B 96/1441 211/187 |
| 7,497,533 | B2 * | 3/2009 | Remmers | A47B 57/42 108/108 |
| 8,157,230 | B2 * | 4/2012 | Krueger | A47B 96/068 248/220.43 |

(Continued)

*Primary Examiner* — Leslie A Nicholson, III
*Assistant Examiner* — Kimberley S Wright
(74) *Attorney, Agent, or Firm* — Raymond Y. Chan; David and Raymond Patent Firm

(57) ABSTRACT

A shelf supporting beam configuration for a shelving apparatus, includes a shelf platform, a plurality of shelf retaining members, and shelf supporting arrangement. Each shelf retaining member has two coupling ends for detachably coupling with two vertically extending posts of the shelving apparatus, and first and second longitudinal edges extended between the two coupling ends to form a boundary frame. The shelf supporting arrangement is integrally extended from each of the shelf retaining members between the first and second longitudinal edges to rigidly support the shelf platform within the boundary frame.

8 Claims, 15 Drawing Sheets

(56) References Cited

U.S. PATENT DOCUMENTS

| | | | | |
|---|---|---|---|---|
| 9,301,610 | B1 * | 4/2016 | Berry | A47B 96/1416 |
| 9,474,369 | B1 * | 10/2016 | Tsai | A47B 47/0083 |
| 2005/0103733 | A1 * | 5/2005 | Saltzberg | A47B 57/50 211/187 |
| 2005/0103734 | A1 * | 5/2005 | Saltzberg | A47B 57/50 211/187 |
| 2008/0296245 | A1 * | 12/2008 | Punzel | A47B 47/021 211/153 |
| 2010/0084354 | A1 * | 4/2010 | Eustace | A47B 57/50 211/134 |
| 2011/0272541 | A1 * | 11/2011 | Wojtowicz | A47B 96/145 248/218.4 |
| 2011/0272542 | A1 * | 11/2011 | Wojtowicz | A47B 87/0215 248/218.4 |
| 2012/0000871 | A1 * | 1/2012 | Troyner | A47B 47/021 211/134 |
| 2012/0000872 | A1 * | 1/2012 | Troyner | A47B 47/021 211/150 |
| 2012/0000873 | A1 * | 1/2012 | Fitzgerald | A47B 57/50 211/153 |
| 2013/0098856 | A1 * | 4/2013 | Troyner | A47B 57/402 211/153 |
| 2014/0116973 | A1 * | 5/2014 | Buckley | A47F 5/00 211/134 |
| 2014/0284294 | A1 * | 9/2014 | Taylor | A47B 45/00 211/134 |
| 2015/0282613 | A1 * | 10/2015 | Chen | A47B 55/00 211/187 |

* cited by examiner

SHELF SUPPORTING BEAM CONFIGURATION FOR SHELVING APPARATUS

CROSS REFERENCE OF RELATED APPLICATION

This is a Continuation-In-Part application that claims the benefit of priority under 35 U.S.C. §119 to a non-provisional application, application Ser. No. 15/004,987, filed Jan. 24, 2016.

NOTICE OF COPYRIGHT

A portion of the disclosure of this patent document contains material which is subject to copyright protection. The copyright owner has no objection to any reproduction by anyone of the patent disclosure, as it appears in the United States Patent and Trademark Office patent files or records, but otherwise reserves all copyright rights whatsoever.

BACKGROUND OF THE PRESENT INVENTION

Field of Invention

The present invention relates to a shelf structure, and more particularly to a shelf supporting beam configuration for a shelving apparatus, which can effectively transfer the downward weighting force of the object to the entire shelving apparatus.

Description of Related Arts

A conventional shelf structure comprises four vertical posts vertically extended from four corners of the shelf structure and a plurality of supporting panels horizontally and spacedly coupled at the vertical posts to form a shelving unit for supporting objects. As shown in FIG. 1, each vertical post comprises a plurality of tubular post members A1 arranged to align end-to-end. Each of the supporting panels comprises a panel body A2 and four tubular connectors A3 provided at four corners of the panel body A2, wherein the end of the post member A1 is inserted into the tubular connector A3 in order to connect the supporting panel at the vertical post. Accordingly, the configuration of the panel body A2 is fixed such that the size of the panel body A2 cannot be adjusted.

An improved shelf structure is provided to enhance the storage space by reducing the size of the post connection, as shown in FIG. 2, wherein the shelf structure comprises four vertical posts each comprising a plurality of L-shaped post members B1 and a plurality of supporting panels horizontally and spacedly coupled at the vertical posts to form a shelving unit. Each supporting panel comprises a plurality of beams B3 coupled between two of the post member B1 and a panel body B4 supported by the beams B3. As shown in FIG. 2, each beam B3 has a top edge B31, a bottom edge B32, and a L-shaped folding flange B33 being folded at the top edge B31, wherein the folding flange B33 has a folding flange portion B34 overlapped on the inner side of the beam B3 and a shelf supporting portion B35 perpendicularly extended from the inner side of the beam B3 to define an upper shelf support surface B36 and a lower shelf support surface B37. Therefore, the beam B3 is reversibly coupled to the post member B1 between a first configuration that the panel body is supported by the upper shelf support surface B36 to provide a shelf configuration with no upstanding lip and a second configuration that the panel body B4 is supported by the lower shelf support surface B37 to provide a shelf configuration with upstanding lip. However, the major drawback of this shelf configuration is that when the object is supported on the panel body B34, the downward weighting force of the object will substantially exert to the folding flange B33 to create stress along the top edge B31 of the beam B3. Since the folding flange is folded along the top edge B31 of the beam B3, the excessive downward force of the panel body B4 and the object thereon will bend the folding flange B33 and even twist the beam B3. Once the folding flange portion B34 or the shelf supporting portion B35 is bent or deformed, the panel body B34 cannot be stably supported by the beam B3. Therefore, the overall structure of the shelving unit become wobble and unstable.

SUMMARY OF THE PRESENT INVENTION

The invention is advantageous in that it provides a shelf supporting beam configuration for a shelving apparatus, which can effectively transfer the downward weighting force of the object to the entire shelving apparatus Another advantage of the invention is to provide a shelf supporting beam configuration for a shelving apparatus, which comprises a plurality of shelf retaining members for coupling at the posts and a plurality of shelf platforms rigidly supported by the shelf retaining members to substantially transfer the downward weighting force of the object on the shelf platform to the posts through the shelf retaining members, so as to prevent any deformation of the shelf supporting beam configuration by the downward weighting force.

Another advantage of the invention is to provide a shelf supporting beam configuration for a shelving apparatus, which provides different supporting orientations to selectively adjust a depth of the supporting frame.

Another advantage of the invention is to provide a shelf supporting beam configuration for a shelving apparatus, wherein the shelf platform is reversibly supported by the shelf retaining members to selectively adjust the depth of the supporting frame. In other words, the user is able to selectively adjust the depth of supporting frame without disassembling the posts.

Another advantage of the invention is to provide a shelf supporting beam configuration for a shelving apparatus, wherein the shelf retaining members are reversibly supported by the posts to selectively adjust the depth of the supporting frame. In other words, the user is able to selectively adjust the depth of supporting frame without disassembling the posts.

Another advantage of the invention is to provide a shelf supporting beam configuration for a shelving apparatus, which does not require to alter the original structural design of the shelf structure, so as to minimize the manufacturing cost of the shelving apparatus incorporating with the shelf supporting beam configuration.

Another advantage of the invention is to provide a shelf supporting beam configuration for a shelving apparatus, wherein no expensive or complicated structure is required to employ in the present invention in order to achieve the above mentioned objects. Therefore, the present invention successfully provides an economic and efficient solution for providing a rigid configuration for the shelf supporting beam configuration of the shelving apparatus.

Additional advantages and features of the invention will become apparent from the description which follows, and may be realized by means of the instrumentalities and combinations particular point out in the appended claims.

According to the present invention, the foregoing and other objects and advantages are attained by a shelf supporting beam configuration for a shelving apparatus which comprises a plurality of vertically extending posts, wherein the shelf supporting beam configuration comprises a shelf platform, a plurality of shelf retaining members, and shelf supporting arrangement.

Each shelf retaining member has two coupling ends for detachably coupling with two vertically extending posts of the shelving apparatus, and first and second longitudinal edges extended between the two coupling ends to form a boundary frame.

The shelf supporting arrangement is integrally extended from each of the shelf retaining members between the first and second longitudinal edges to rigidly support the shelf platform within the boundary frame.

Still further objects and advantages will become apparent from a consideration of the ensuing description and drawings.

These and other objectives, features, and advantages of the present invention will become apparent from the following detailed description, the accompanying drawings, and the appended claims.

DETAILED DESCRIPTION OF THE PREFERRED EMBODIMENT

The following description is disclosed to enable any person skilled in the art to make and use the present invention. Preferred embodiments are provided in the following description only as examples and modifications will be apparent to those skilled in the art. The general principles defined in the following description would be applied to other embodiments, alternatives, modifications, equivalents, and applications without departing from the spirit and scope of the present invention.

Figure 1:
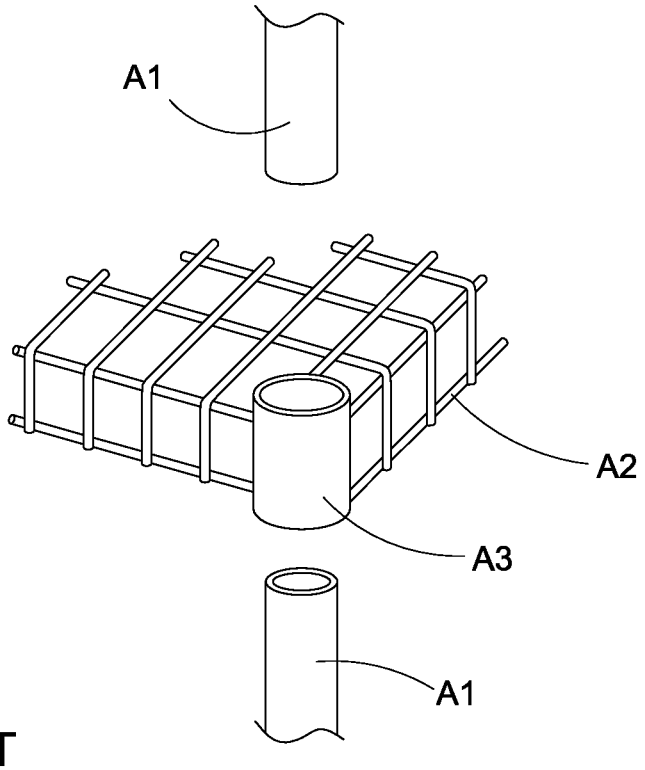
FIG.1 PRIOR ART
FIG. 1 illustrates a first conventional shelf structure.
Figure 2:
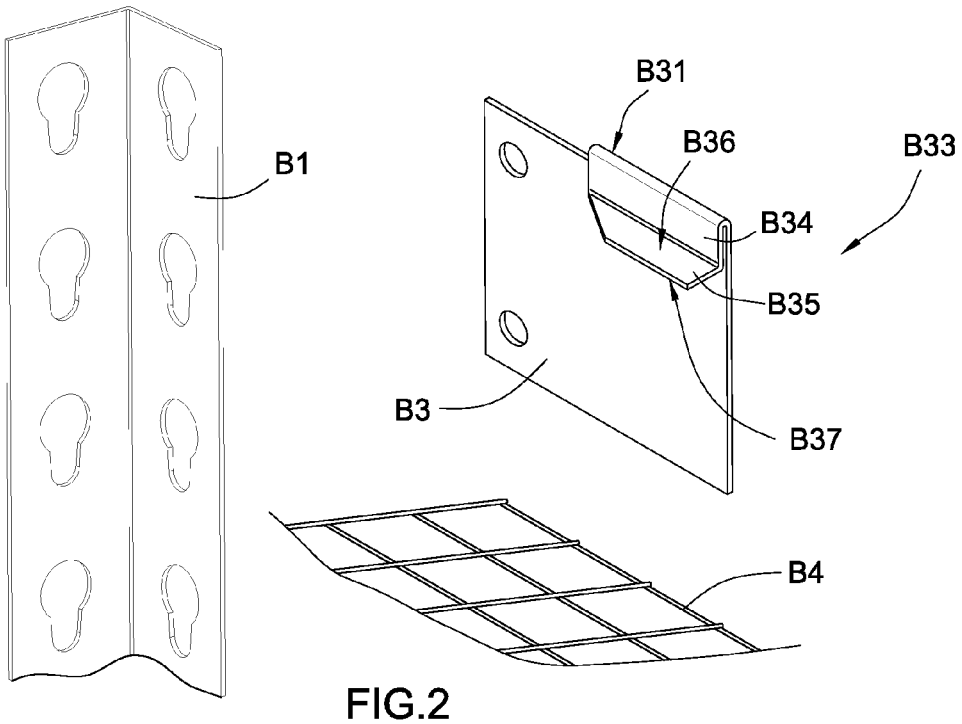
FIG.2 PRIOR ART
FIG. 2 illustrates a second conventional shelf structure.
Figure 3:
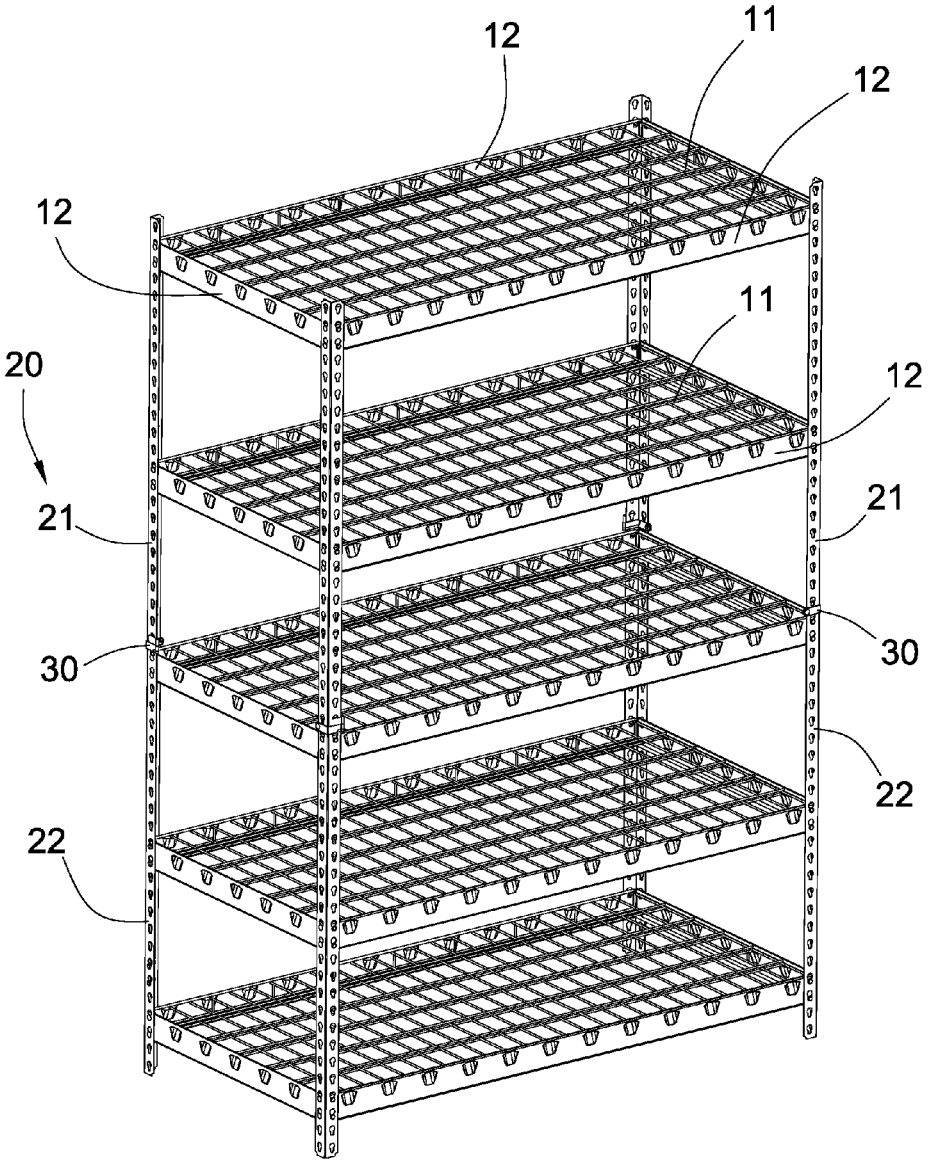
FIG. 3 is a perspective view of a shelving apparatus according to a preferred embodiment of the present invention.
Figure 4:
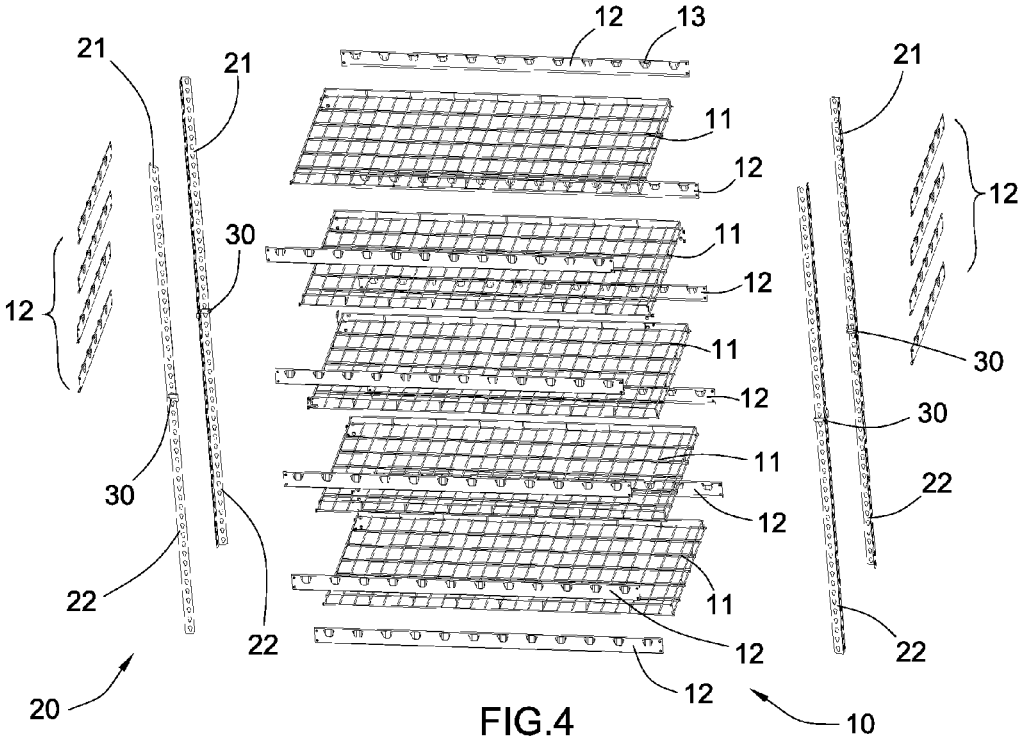
FIG. 4 is an exploded perspective view of the shelving apparatus according to the above preferred embodiment of the present invention.
Figure 5:
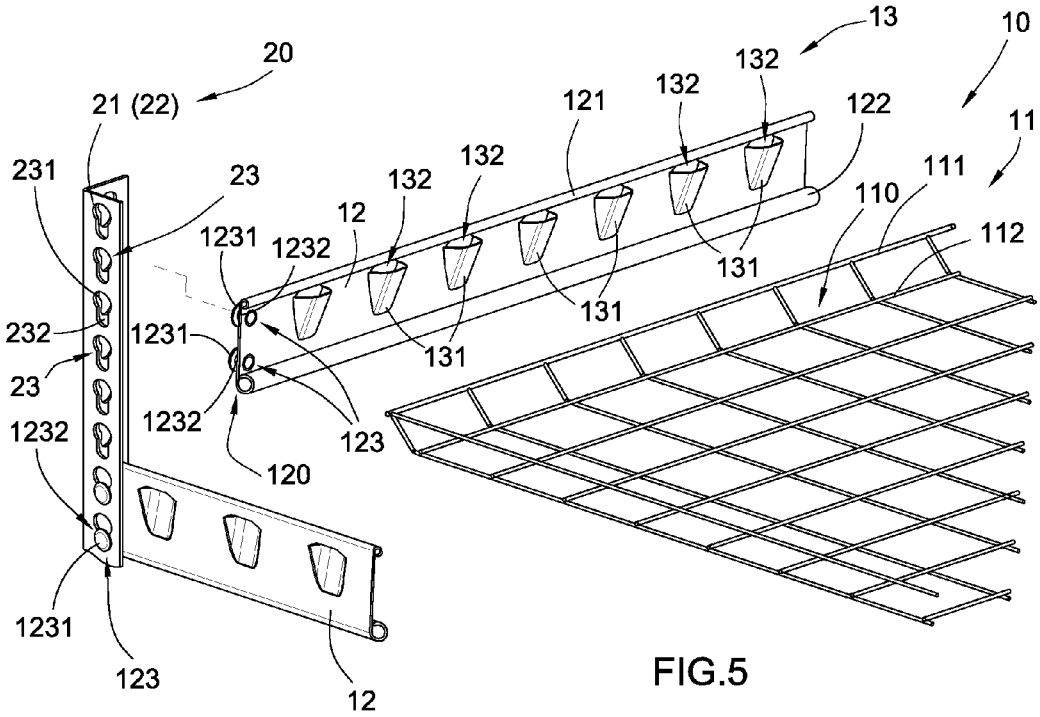
FIG. 5 is a perspective view of a supporting frame of the shelving apparatus according to the above preferred embodiment of the present invention.

Referring to FIGS. 3 to 5, a shelving apparatus according to a preferred embodiment of the present invention is illustrated, wherein the shelving apparatus comprises a supporting frame 10, a plurality of vertically extending posts 20 for detachably coupling with the supporting frame 10.

According to the preferred embodiment, the supporting frame 10 is incorporated with one or more shelf supporting beam configurations and is supported by the posts 20 in a horizontally oriented manner for supporting one or more objects on the supporting frame 10. In particular, each of the posts 20 is supported in a vertically oriented manner to serve as a corner post of the shelving apparatus. In particular, four posts 20 are provided that four corners of the supporting frame 10 are coupled at the posts 20 respectively. Preferably, each post 20 has at least an upper post member 21 and at least a lower post member 22 coupled to the upper post member 21 end-to-end via a joint 30 to form the post 20.

According to the preferred embodiment, each of the shelf supporting beam configurations of the supporting frame 10 comprises a shelf platform 11, a plurality of shelf retaining members 12, and a shelf supporting arrangement 13.

Each of the shelf retaining members 12 is detachably coupled with two of the posts 20, such that the shelf retaining members 12 form a boundary frame to support the shelf platform 11 therewithin. In particular, each of the shelf retaining members 12 has two coupling ends 120 arranged for detachably coupling with two of the posts 20, and first and second longitudinal edges 121, 122 extended between the two coupling ends 120 to form the boundary frame. Accordingly, two of the shelf retaining members 12 serve as a front boundary and a rear boundary respectively, and the other two shelf retaining members 12 serve as two side boundaries respectively, such that the boundary frame is formed by the front boundary, the rear boundary, and the side boundary. Preferably, the length of the front boundary matches with the length of the rear boundary and the side boundaries are identical in length.

As shown in FIG. 5, each of the shelf retaining members 12 has a planar structure to have the first and second longitudinal edges 121, 122 extended parallel with each other, wherein two ends of each of the shelf retaining members 12 are detachably engaged with keyholes 23 of the two posts 20. Accordingly, two fasteners 123 are provided at each coupling end 120 of the shelf retaining member 12 to engage with two keyholes 23 of the corresponding post 20. In particular, two fastener holes are formed at each coupling end of the shelf retaining member 12, wherein the two fasteners 123 are engaged with the fastener holes respectively. Each of the fasteners 123 is inserted into an upper hole portion 231 of the keyhole 23 and is slid to a lower hole portion 232 from the upper hole portion 231, so as to securely couple the shelf retaining member 12 at the post 20. According to the preferred embodiment, each of the fasteners 123 is riveted to the respective coupling end 120 of the shelf retaining member 12 and has a head 1231 having a size larger than the lower hole portion 232 and slightly smaller than the upper hole portion 231 so as to be fittingly inserted through the upper hole portion 231 of the corresponding keyhole 23 with a neck 1232, protruded between the head 1231 and the shelf retaining member 12, having a size smaller than the head 1231 while fittingly sliding into the lower hole portion 232 of the corresponding keyhole 23 from the upper hole portion 231, so as to securely couple the shelf retaining member 12 at the post 20.

The first and second longitudinal edges 121, 122 of the shelf retaining member 12 are two folded edges respectively, wherein two longitudinal edge portions of the shelf retaining members 12 are inwardly folded on an inner side thereof to form the longitudinal edges 121, 122 respectively to reinforce the planar configuration of the shelf retaining member 12.

According to the preferred embodiment, the shelf supporting arrangement 13 is integrally extended from each of the shelf retaining members 12 between the first and second longitudinal edges 121, 122 to rigidly support the shelf platform 10 within the boundary frame.

Figure 6A:
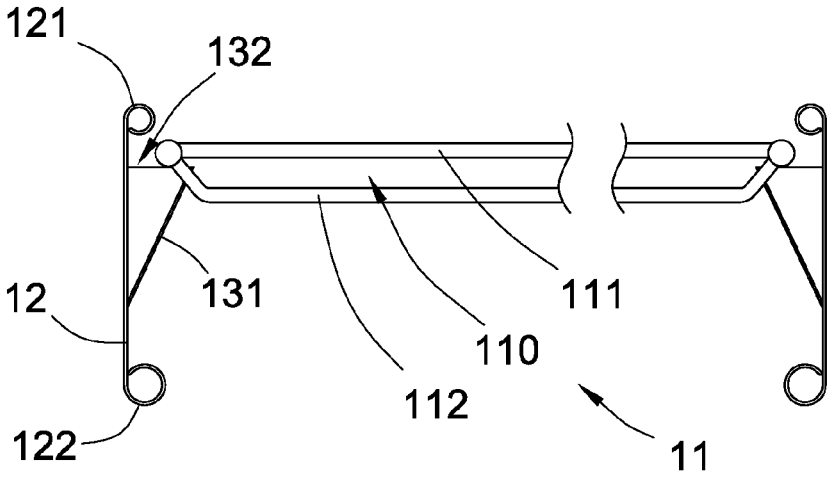
FIG. 6A illustrates the shelf platform supported at the first position according to the above preferred embodiment of the present invention.
Figure 6B:
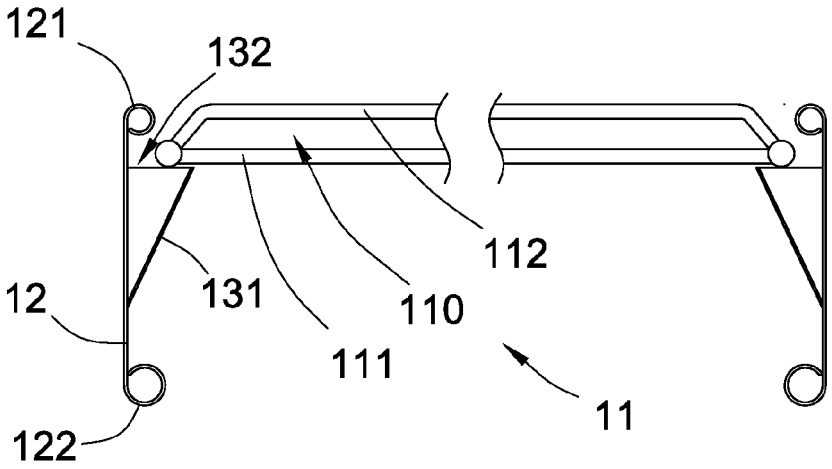
FIG. 6B illustrates the shelf platform supported at second first position according to the above preferred embodiment of the present invention.

The shelf supporting arrangement 13 comprises a plurality of supporting tabs 131 horizontally aligned with each other and integrally protruded from the inner side of the shelf retaining member 12 between the first and second longitudinal edges 121, 122 thereof, and defines a plurality of discrete supporting surfaces 132 on the supporting tabs 131 to support the shelf platform 11 thereon. As shown in FIGS. 5, 6A, and 6B, each of the supporting tabs 131 is integrally bent from the inner side of the shelf retaining member 12 to define the supporting surface 132 close to the first longitudinal edge 121 of the shelf retaining member 12. Preferably, each of the supporting tabs 131 has a triangular shape defining a peak pointing toward the second longitudinal edge 122 of the shelf retaining member 12 and a flat surface as the supporting surface 132 facing toward the first longitudinal edge 121 of the shelf retaining member 12. It is worth mentioning that the discrete supporting surfaces 132 are aligned with each other at the same planar direction to form a flat support for supporting the shelf platform 11.

According to the preferred embodiment, the shelf platform 11 is a wire shelf made by a plurality of longitudinal and transverse wires intersecting with each other. It should be appreciated that the shelf platform 11 can be made of other configurations such as solid panel, laminated panel, or other materials such as wood or plastic.

The shelf platform 11 is reversibly supported by the boundary frame at a first position and a reversibly second position to selectively adjust a depth of the shelf platform 11. In particular, the shelf platform 11 has a surrounding edge 111 and a base panel 112 located at different horizontal levels of the surrounding edge 111. Accordingly, a circumferential size of the surrounding edge 111 is larger than a circumferential size of the base panel 112. At the first position, as shown in FIG. 6A, the surrounding edge 111 of the shelf platform 11 is supported by the boundary frame via the discrete supporting surfaces 132 at a position that the base panel 112 is located above the surrounding edge 111, such that the base panel 112 is aligned with the first longitudinal edge 121 of the shelf retaining member 12 to minimize the depth of the shelf platform 11. At the second position, as shown in FIG. 6B, the surrounding edge 111 of the shelf platform 11 is supported by the boundary frame via the discrete supporting surfaces 132 at a position that the base panel 112 is located below the surrounding edge 111 to maximize the depth of the shelf platform 11. Accordingly, the shelf platform 11 has a basket configuration to define a cavity 110 within the surrounding edge 111 and the base panel 112, wherein an opening of the cavity 110 is formed within the surrounding edge 111. When the shelf platform 11 is supported at the first position, as shown in FIG. 6A, the cavity 110 is orientated up-side-down that the opening of the cavity 110 faces downward, such that the object can be supported on the base panel 112 above the cavity 110 (not within the cavity 110). When the shelf platform 11 is supported at the second position, as shown in FIG. 6B, the opening of the cavity 110 faces upward, such that the object can be supported on the base panel 112 within the cavity 110.

It is worth mentioning that when the shelf platform 11 is supported at the first position, the base panel 112 is aligned with the first longitudinal edge 121 of the shelf retaining member 12, such that the base panel 112 provides a boundary-less supporting surface for the user to load or unload the object thereon without any obstruction. When the shelf platform 11 is supported at the second position, the boundary frame forms an obstruction wall of the cavity 110. In addition, the user is able to selectively adjust the depth of supporting frame 10 by simply removing the shelf platform 11 from the shelf retaining members 12 and reversibly resting the shelf platform 11 back on the shelf retaining members 12 without disassembling the posts 20. In particular, the user does not require to disassemble the shelf retaining members 12 from the posts 20.

It is worth mentioning that since the supporting tabs 131 are integrally protruded from the inner side of the shelf retaining member 12 to the support the shelf platform 11 via the supporting surfaces 132, the downward weighting force of the object will be evenly distributed along the shelf retaining member 12 between the two coupling ends 120 thereof to minimize stress created at the shelf retaining member 12. In addition, the first and second longitudinal edges 121, 122 of the shelf retaining member 12 are two folded edges respectively to reinforce the planar configuration of the shelf retaining member 12 so as to prevent any twisting force created by the downward weighting force of the object.

Figure 7:
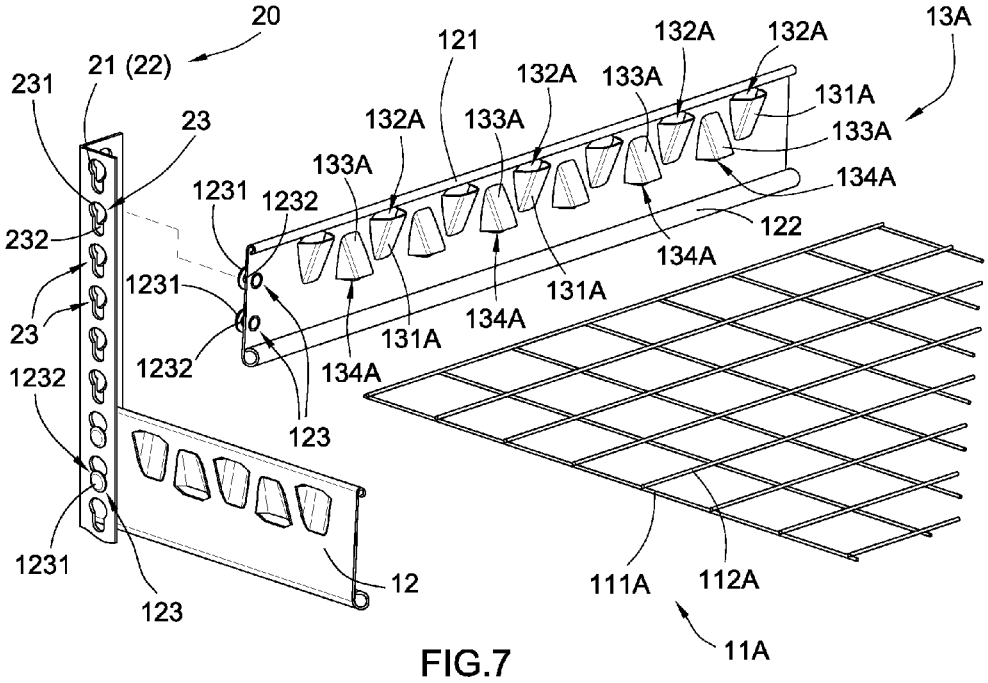
FIG. 7 illustrates a first alternative mode of the supporting frame of the shelving apparatus according to the above preferred embodiment of the present invention, showing the shelf retaining member at the first position.
Figure 7A:
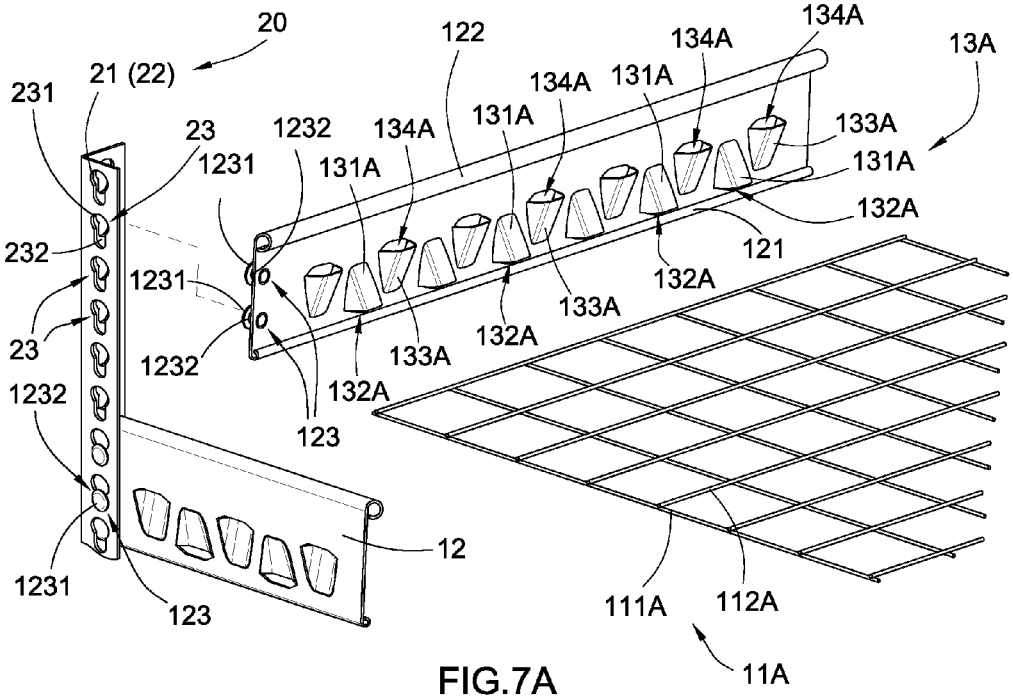
FIG. 7A illustrates the first alternative mode of the supporting frame of the shelving apparatus according to the above preferred embodiment of the present invention, showing the shelf retaining member at the second position.

FIG. 7 illustrates a first alternative mode of the shelf supporting arrangement 13A. Accordingly, the shelf supporting arrangement 13A comprises a plurality of supporting tabs 131A horizontally aligned with each other and integrally protruded from the inner side of the shelf retaining member 12 between the first and second longitudinal edges 121, 122 thereof, and defines a plurality of discrete supporting surfaces 132A on the supporting tabs 131A to support the shelf platform 11A thereon. As shown in FIG. 7, each of the supporting tabs 131A is integrally bent from the inner side of the shelf retaining member 12 to define the supporting surface 132A close to the first longitudinal edge 121 of the shelf retaining member 12. Preferably, each of the supporting tabs 131A has a triangular shape defining a peak pointing toward the second longitudinal edge 122 of the shelf retaining member 12 and a flat surface as the supporting surface 132A facing toward the first longitudinal edge 121 of the shelf retaining member 12. It is worth mentioning that the discrete supporting surfaces 132A are aligned with each other at the same planar direction to form a flat support for supporting the shelf platform 11A.

The shelf supporting arrangement 13A comprises a plurality of second supporting tabs 133A horizontally aligned with each other and integrally protruded from the inner side of the shelf retaining member 12 between the first and second longitudinal edges 121, 122 thereof, and defines a plurality of second discrete supporting surfaces 134A on the second supporting tabs 133A to support the shelf platform 11A thereon. As shown in FIG. 7, the supporting tabs 131A are alternated with the second supporting tabs 133A. Accordingly, the second supporting tabs 133A are additional supporting tabs of the first supporting tabs 131A. Preferably, the supporting tabs 131A are identical to the second supporting tabs 126A, wherein an orientation of each of the supporting tabs 131A is opposite to an orientation of each of the second supporting tabs 133A. Each of the second supporting tabs 133A is integrally bent from the inner side of the shelf retaining member 12 to define the second supporting surface 134A. Preferably, each of the second supporting tabs 133A has a triangular shape defining a peak pointing toward the first longitudinal edge 121 of the shelf retaining member 12 and a flat surface as the second supporting surface 134A facing toward the second longitudinal edge 122 of the shelf retaining member 12. It is worth mentioning that the second discrete supporting surfaces 134A are aligned with each other at the same planar direction to form a flat support for supporting the shelf platform 11A. In addition, a distance between the first longitudinal edge 121 and the first supporting surface 132A of the shelf supporting arrangement 13A is smaller than a distance between the second longitudinal edge 122 of the shelf retaining member 12 and the second supporting surface 134A of the shelf supporting arrangement 13A.

Accordingly, the shelf platform 11A has a planar configuration for being supported by the boundary frame. In particular, the shelf platform 11A is reversibly supported by the bounding frame at a first position and a reversibly second position to selectively adjust a depth of the shelf platform 11A. Accordingly, the shelf platform 11A has a surrounding edge 111A and a base panel 112A located at same horizontal level of the surrounding edge 111A. At the first position, the surrounding edge 111A of the shelf platform 11A is supported by the first supporting surfaces 132A of the first supporting tabs 131A, such that the base panel 112A is aligned with the first longitudinal edge 121A of the shelf retaining member 12A to minimize the depth of the shelf platform 11A. At the second position, the surrounding edge 111A of the shelf platform 11A is supported by the second supporting surfaces 134A of the second supporting tabs 133A to maximize the depth of the shelf platform 11A.

Accordingly, the shelf platform 11A has a panel configuration to be selectively supported at different horizontal levels between the first and second longitudinal edges 121, 122 of the shelf retaining member 12. Accordingly, the shelf platform 11A has a surrounding edge 111A and a base panel 112A located at same horizontal level of the surrounding edge 111A.

When the surrounding edge 111A of the shelf platform 11A is supported at the first position that the first longitudinal edge 121 of the shelf retaining member 12 is orientated above the second longitudinal edge 122 thereof, the shelf platform 11A is supported by the first supporting surfaces 132A of the first supporting tabs 131A to raise the horizontal level of the shelf platform 11A close to the first longitudinal edge 121 of the shelf retaining member 12. It is worth mentioning that when the first longitudinal edge 121 of the shelf retaining member 12 is orientated above the second longitudinal edge 122 thereof, the first supporting surfaces 132A of the first supporting tabs 131A are positioned above the second supporting surfaces 134A of the second supporting tabs 133A.

The shelf retaining member 12 is reversibly coupled to the posts 20 for supporting the shelf platform 11A at the second position, wherein the second longitudinal edge 122 of the shelf retaining member 12 is orientated above the first longitudinal edge 121 thereof. When the surrounding edge 111A of the shelf platform 11A is supported at the second position, the shelf platform 11A is supported by the second supporting surfaces 134A of the second supporting tabs 133A to drop the horizontal level of the shelf platform 11A away from the second longitudinal edge 122 of the shelf retaining member 12. It is worth mentioning that when the second longitudinal edge 122 of the shelf retaining member 12 is orientated above the first longitudinal edge 121 thereof, the second supporting surfaces 134A of the second supporting tabs 133A are positioned above the first supporting surfaces 132A of the first supporting tabs 131A.

It is worth mentioning that when the shelf platform 11A is supported at the first position, the base panel 112A is aligned with the first longitudinal edge 121 of the shelf retaining member 12, such that the base panel 112A provides a boundary-less supporting surface for the user to load or unload the object thereon without any obstruction. When the shelf platform 11A is supported at the second position, the boundary frame forms an obstruction wall. In addition, the user is able to selectively adjust the depth of supporting frame 10 by reversibly mounting the shelf retaining members 12 to the posts 20 and resting the shelf platform 11A on the shelf retaining members 12 without disassembling the posts 20.

Figure 8:
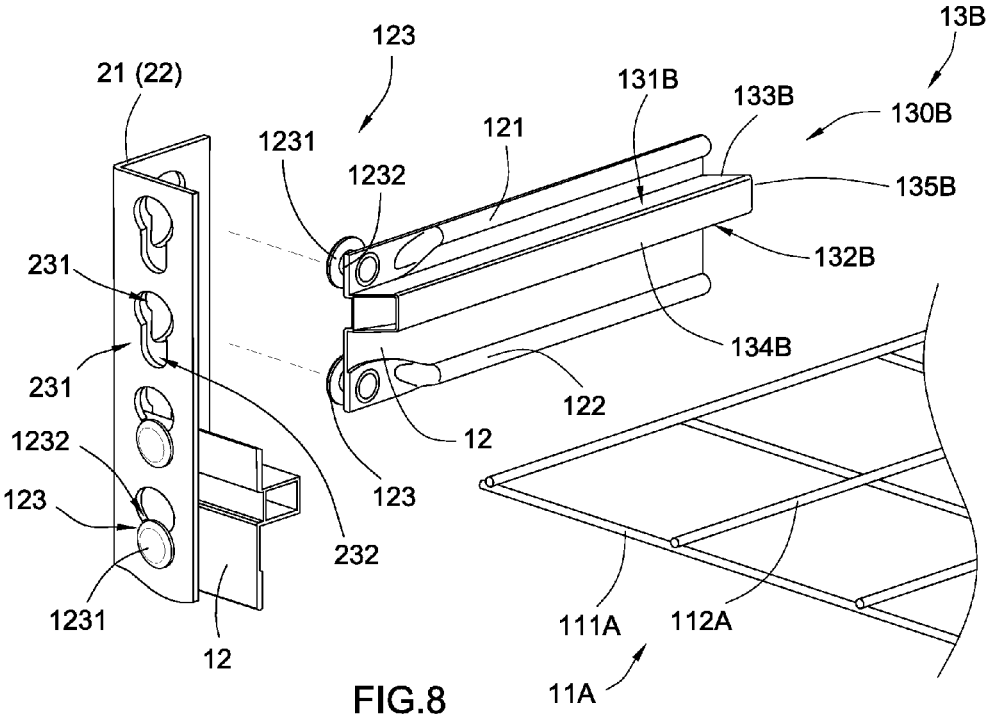
FIG. 8 illustrates a second alternative mode of the supporting frame of the shelving apparatus according to the above preferred embodiment of the present invention.

FIG. 8 illustrates a second alternative mode of the shelf supporting arrangement 13B. Accordingly, the shelf supporting arrangement 13B comprises a supporting bar 130B horizontally protruded from the inner side of the shelf retaining member 12 to define a first supporting surface 131B and an opposed second supporting surface 132B to selectively support the shelf platform 11A. Accordingly, the first supporting surface 131B is extended parallel to the second supporting surface 132B. In addition, a distance between the first longitudinal edge 121 of the shelf retaining member 12 and the first supporting surface 131B is smaller than a distance between the second longitudinal edge 122 of the shelf retaining member 12 and the second supporting surface 132B.

Accordingly, the supporting bar 130B, having a rectangular cross section, has a first bar panel 133B defining the first supporting surface 131B thereon, a second bar panel 134B defining the second supporting surface 132B thereon, and a reinforcing panel 135B extended between the first and second bar panels 133B, 134B to reinforce a rigidity of each of the first and second bar panels 133B, 134B.

Accordingly to the preferred embodiment, the shelf platform 11A has a planar configuration for being supported by the boundary frame. In particular, the shelf platform 11A is reversibly supported by the bounding frame at a first position and a reversibly second position to selectively adjust a depth of the shelf platform 11A. Accordingly, the shelf platform 11A has a surrounding edge 111A and a base panel 112A located at same horizontal level of the surrounding edge 111A. At the first position, the surrounding edge 111A of the shelf platform 11A is supported by the first supporting surfaces 131B of the supporting bar 130B, such that the base panel 112A is aligned with close to the first longitudinal edge 121 of the shelf retaining member 12 to minimize the depth of the shelf platform 11A. At the second position, the surrounding edge 111A of the shelf platform 11A is supported by the second supporting surfaces 132B of the supporting bar 120B to maximize the depth of the shelf platform 11A.

Accordingly, the shelf platform 11A has a panel configuration to be selectively supported at different horizontal levels between the first and second longitudinal edges 121, 122 of the shelf retaining member 12. When the shelf platform 11A is supported at the first position that the first longitudinal edge 121 of the shelf retaining member 12 is orientated above the second longitudinal edge 122 thereof, the shelf platform 11A is supported by the first supporting surface 131B of the supporting bar 130B to raise the horizontal level of the shelf platform 11A close to the first longitudinal edge 121 of the shelf retaining member 12. It is worth mentioning that when the first longitudinal edge 121 of the shelf retaining member 12 is orientated above the second longitudinal edge 122 thereof, the first supporting surface 131B of the supporting bar 130B are positioned above the second supporting surface 132B of the supporting bar 130B.

The shelf retaining member 12 is reversibly coupled to the posts 20 for supporting the shelf platform 11A at the second position, wherein the second longitudinal edge 122 of the shelf retaining member 12 is orientated above the first longitudinal edge 121 thereof. When the shelf platform 11B is supported at the second position, the shelf platform 11B is supported by the second supporting surface 132B of the supporting bar 130B to drop the horizontal level of the shelf platform 11A away from the second longitudinal edge 122 of the shelf retaining member 12. It is worth mentioning that when the second longitudinal edge 122 of the shelf retaining member 12 is orientated above the first longitudinal edge 121 thereof, the second supporting surface 132B of the supporting bar 130B are positioned above the first supporting surface 131B of the supporting bar 130B.

It is worth mentioning that when the shelf platform 11A is supported at the first position, the base panel 112A is aligned with the first longitudinal edge 121 of the shelf retaining member 12, such that the base panel 112A provides a boundary-less supporting surface for the user to load or unload the object thereon without any obstruction. When the shelf platform 11A is supported at the second position, the boundary frame forms an obstruction wall. In addition, the user is able to selectively adjust the depth of supporting frame 10 by reversibly mounting the shelf retaining members 12 to the posts 20 and resting the shelf platform 11A on the shelf retaining members 12 without disassembling the posts 20.

Figure 9A:
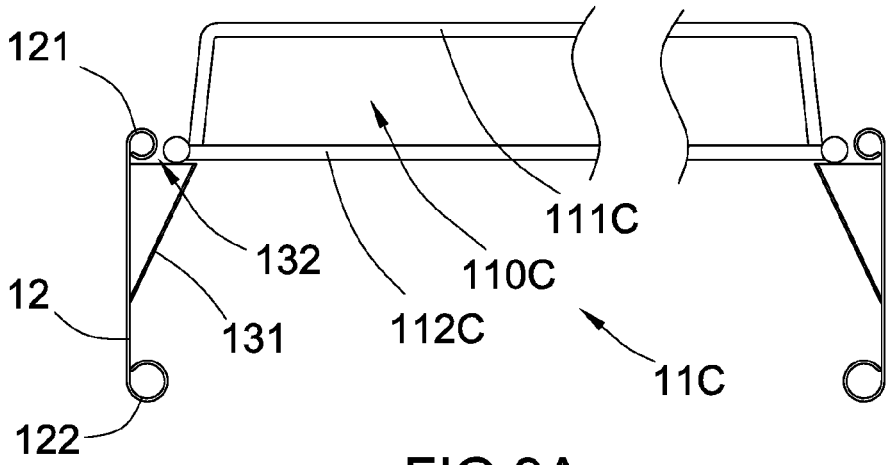
FIGS. 9A and 9B illustrate an alternative mode of the shelf platform of the shelving apparatus according to the above preferred embodiment of the present invention.
Figure 9B:
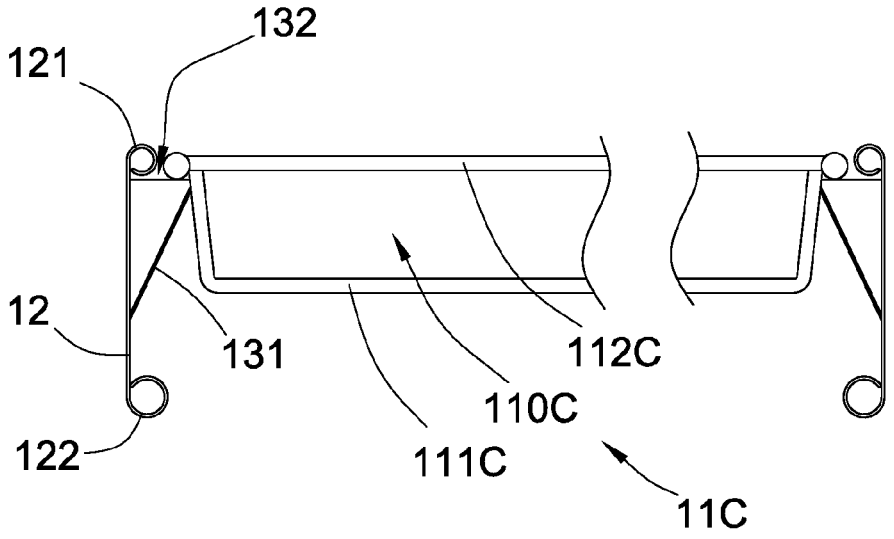

FIGS. 9A and 9B illustrate an alternative mode of the shelf platform 11C which is reversibly supported by the boundary frame at a first position and a reversibly second position to selectively adjust a depth of the shelf platform 11C. In particular, the shelf platform 11C has a surrounding edge 111C and a base panel 112C located at different horizontal levels of the surrounding edge 111C. Accordingly, a circumferential size of the surrounding edge 111C is smaller than a circumferential size of the base panel 112C. At the first position, as shown in FIG. 9A, the base panel 112C of the shelf platform 11C is supported by the boundary frame via the discrete supporting surfaces 132 at a position that the surrounding edge 111C of the shelf platform 11C is located above the base panel 112C thereof to maximize the depth of the shelf platform 11C. At the second position, as shown in FIG. 9B, the base panel 112C of the shelf platform 11C is supported by the boundary frame via the discrete supporting surfaces 132 at a position that the surrounding edge 111C of the shelf platform 11C is located below the base panel 112C thereof to minimize the depth of the shelf platform 11C. Accordingly, the shelf platform 11C has a basket configuration to define a cavity 110C within the surrounding edge 111C and the base panel 112C, wherein an opening of the cavity 110C is formed within the surrounding edge 111C. When the shelf platform 11C is supported at the first position, as shown in FIG. 9A, the opening of the cavity 110C faces upward, such that the object can be supported on the base panel 112C within the cavity 110C. When the shelf platform 11C is supported at the second position, as shown in FIG. 9B, the cavity 110C is orientated up-side-down that the opening of the cavity 110C faces downward, such that the object can be supported on the base panel 112C above the cavity 110C (not within the cavity 110C).

It is worth mentioning that when the shelf platform 11C is supported at the first position, the surrounding edge 111C of the shelf platform 11C forms an obstruction wall of the cavity 110C. When the shelf platform 11C is supported at the second position, the base panel 112C is aligned with the first longitudinal edge 121 of the shelf retaining member 12, such that the base panel 112 provides a boundary-less supporting surface for the user to load or unload the object thereon without any obstruction.

It is worth mentioning that the base panel 112C is aligned with the first longitudinal edge 121 of the shelf retaining member 12 at the first and second positions. At the first position, the surrounding edge 111C of the shelf platform 11C is located above the first longitudinal edge 121 of the shelf retaining member 12. At the second position, the surrounding edge 111C of the shelf platform 11C is located below the first longitudinal edge 121 of the shelf retaining member 12.

In addition, the user is able to selectively adjust the depth of supporting frame 10 by simply removing the shelf platform 11C from the shelf retaining members 12 and reversibly resting the shelf platform 11C back on the shelf retaining members 12 without disassembling the posts 20. In particular, the user does not require to disassemble the shelf retaining members 12 from the posts 20.

Figure 10:
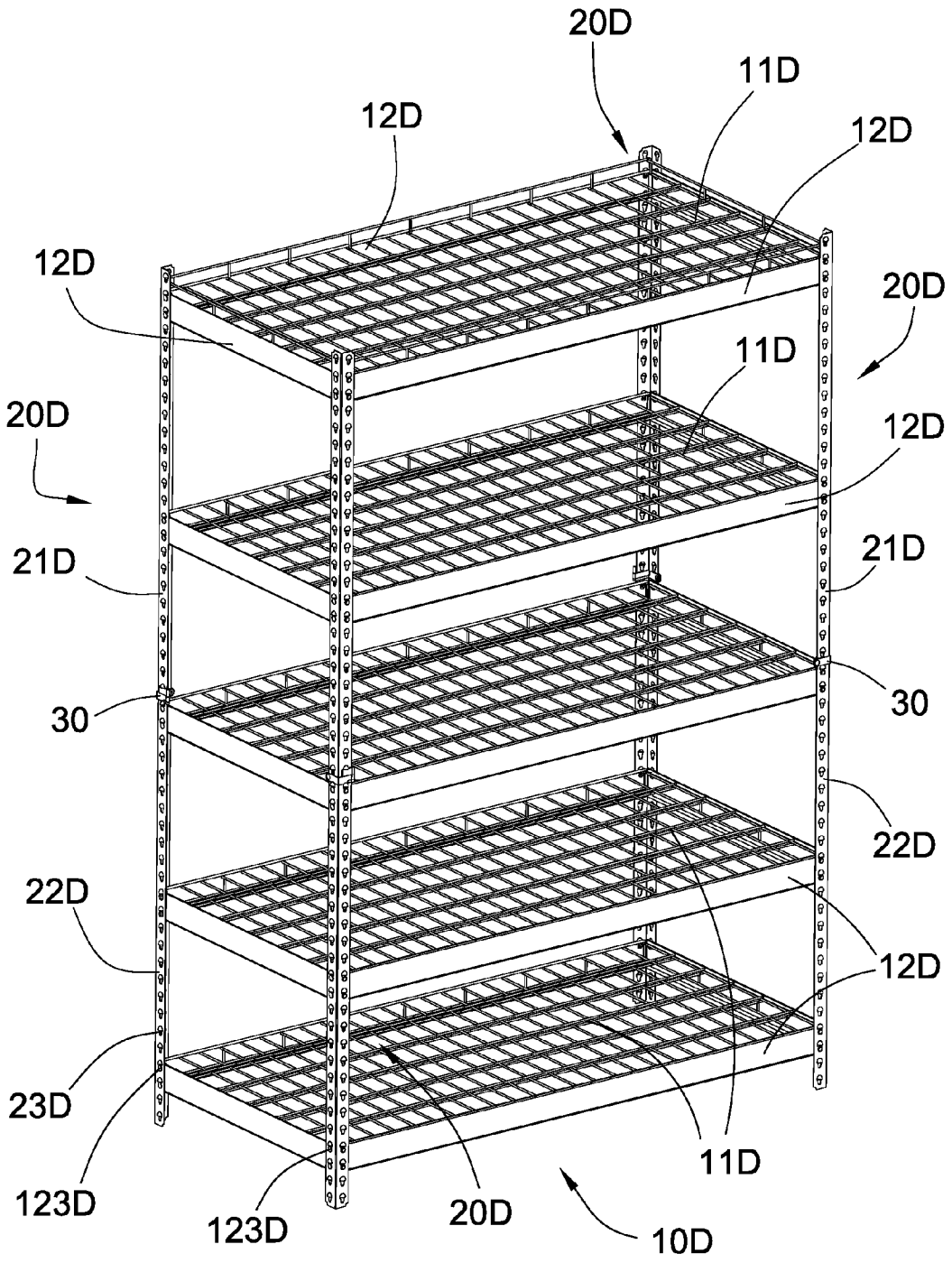
FIG. 10 a perspective view of a shelving apparatus according to a second preferred embodiment of the present invention.

As shown in FIG. 10, a shelving apparatus according to a second embodiment illustrates an alternative mode of the first embodiment, wherein the structural configuration of the shelving apparatus of the second embodiment is the modification of the first embodiment. Accordingly, the upper and lower post members 21D, 22D of the post 20D of the second embodiment are configured the same as the upper and lower post members 21, 22 of the post 20 of the first embodiment, wherein the upper and lower post members 21D, 22D are coupled with each other via the joint 30.

Figure 13:
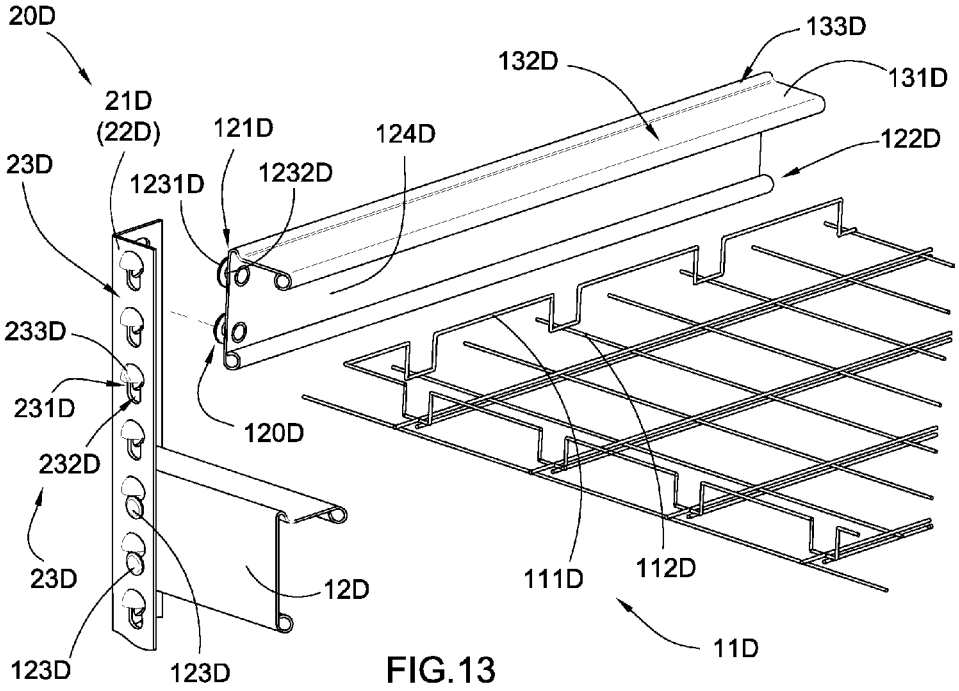
FIG. 13 is a partially perspective view of the shelving apparatus according to the above preferred embodiment of the present invention to illustrate the structural configuration of the shelving apparatus.

As shown in FIGS. 13 and 14, a plurality of keyholes 23D are alignedly formed on a first post wall 211D, 221D and a second post wall 212D, 222D of each of the upper and lower post members 21D, 22D. Each of the keyholes 23D has an upper hole portion 231D and a lower hole portion 232D, wherein a size of the upper hole portion 231D is larger than a size of the lower hole portion 232D. Each of the upper and lower post members 21D, 22D further comprises a plurality of keyhole covers 233D integrally and outwardly protruded from the outer side of each of the first post wall 211D, 221D and the second post wall 212D, 222D. In particular, each of the keyhole covers 233D is integrally extended to partially cover the upper hole portion 231D of each of the keyholes 23D at the outer side of the post members 21D, 22D while the lower hole portion 232D of each of the keyholes 23D is uncovered. The shape and size of the keyhole cover 233D is configured according to the shape and size of the upper hole portion 231D of the keyhole 23D. In order to form the keyhole covers 233D, each of the upper and lower post members 21D, 22D is punched at the inner side thereof via a punching machine to bend the keyhole covers 233D out from the outer side of each of the upper and the lower post members 21D, 22D.

As shown in FIGS. 10 to 13, each of the shelf retaining members 12D has a planar structure to have the first and second longitudinal edges 121D, 122D extended parallel with each other, wherein two ends of each of the shelf retaining members 12D are detachably engaged with keyholes 23D of the two posts 20D. Accordingly, two fasteners 123D are provided at each coupling end 120D of the shelf retaining member 12D to engage with two keyholes 23D of the corresponding post 20D. In particular, two fastener holes are formed at each coupling end of the shelf retaining member 12D, wherein the two fasteners 123D are affixed to the shelf retaining member 12D via the fastener holes respectively. According to the preferred embodiment, each of the fasteners 123D is riveted to the respective coupling end 120D of the shelf retaining member 12D and has a head 123D1 having a size larger than the lower hold portion 232D and slightly smaller than the upper hole portion 231D so as to fittingly inserted through the upper hole portion 231D while guiding by the keyhole cover 233D not to prevent the head 123D1 from over inserting and to guide a neck 1232D, protruded between the head 123D1 and the shelf retaining member 12D and having a size smaller than the head 123D1, to slide into the lower hole portion 232D of the corresponding keyhole 23D from the upper hole portion 231D, so as to securely couple the shelf retaining member 12D at the post member 21D of the post 20D.

Figure 11:
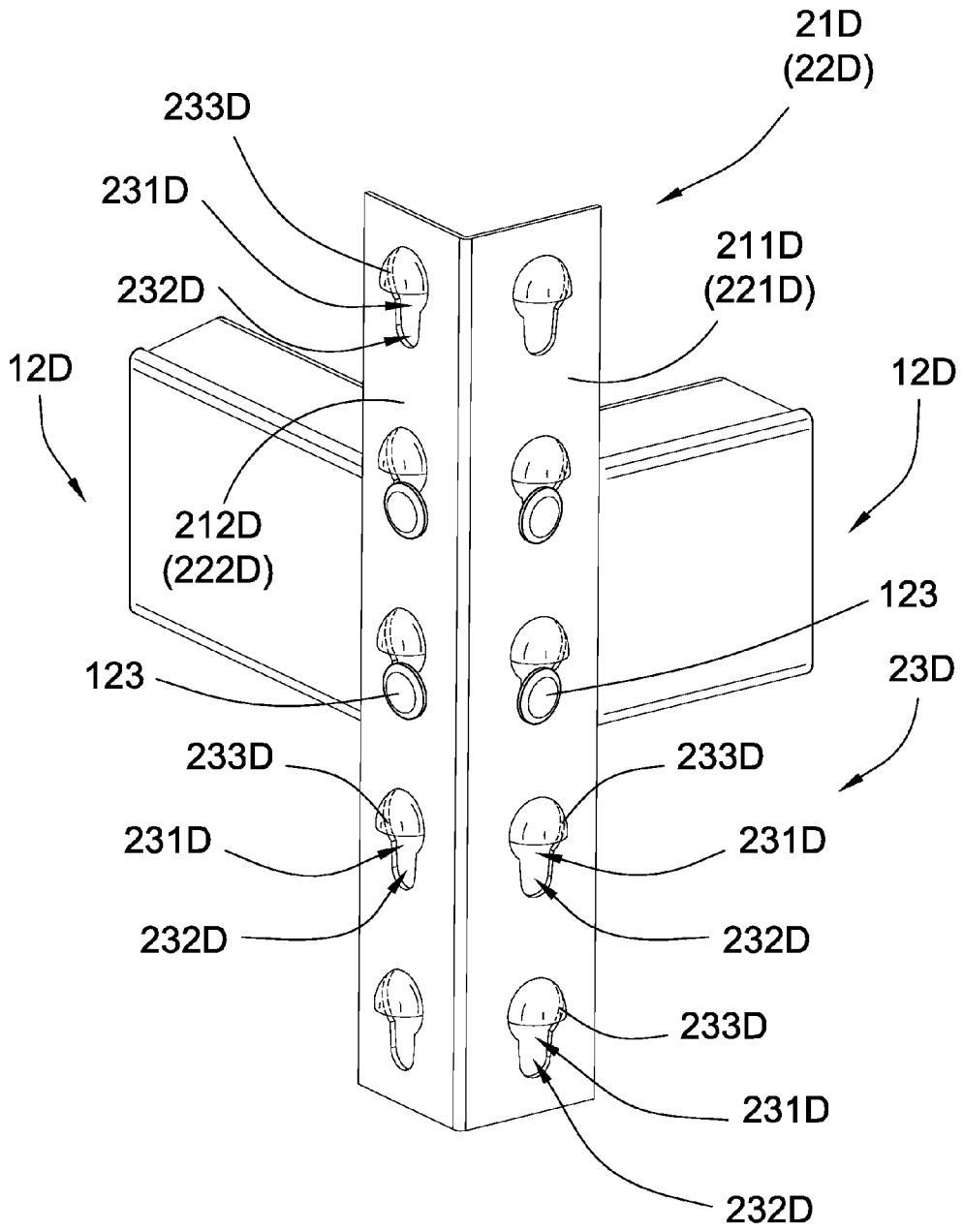
FIG. 11 is a perspective view of the post of the shelving apparatus according to the above second embodiment of the present invention.
Figure 11A:
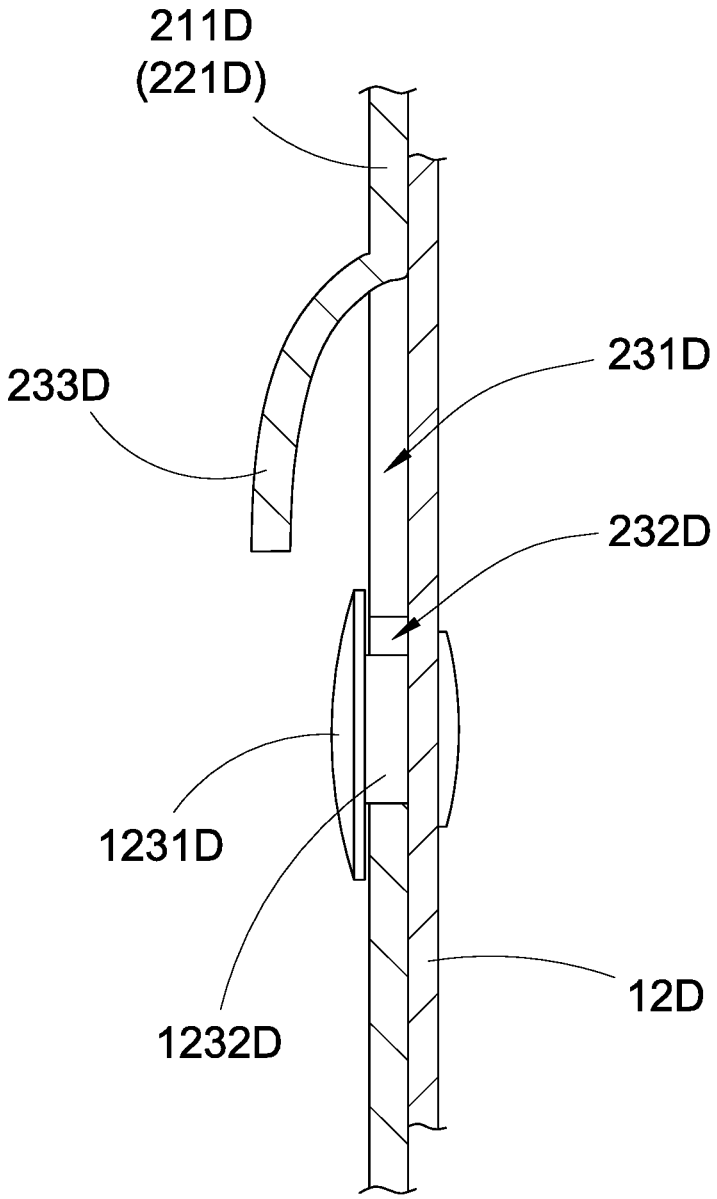
FIG. 11A is a sectional view illustrating the engagement between the fastener and keyhole of the post of the shelving apparatus according to the above second embodiment of the present invention.

It is worth mentioning that when the fastener 123D is inserted into the upper hole portion 231D of the keyhole 23D, as shown in FIG. 11A, the fastener 123D is blocked by the respective keyhole cover 233D to ensure the engagement between the fastener 123D and the keyhole 23D. Therefore, the fastener 123D can be correctly slid to the lower hole portion 232D from the upper hole portion 231D, so as to securely couple the shelf retaining member 12D at the post 20D. In addition, since the fastener 123D is slid at the lower hole portion 232D of the keyhole 23D, a portion of the fastener 123D, such as the head 123D1, can be covered and protected by the keyhole cover 233D to protect the fastener 123D from being damaged by any external force at the outer side of each of the upper and the lower post members 21D, 22D.

It is worth mentioning that the shelf platform 11D or the shelf retaining members 12D is reversibly supported at a first position and a reversibly second position to selectively adjust a depth of the shelf platform 11D. The structural configuration of the shelf platform 11D and the shelf retaining members 12D are the same as the above mentioned embodiments. As shown in FIG. 10, the top level of the shelf apparatus is shown that the shelf retaining members 12D form a boundary frame for the shelf platform 11D while the second to bottom levels of the shelf apparatus are shown that the shelf retaining members 12D form a boundary-less frame for the shelf platform 11D.

Figure 12:
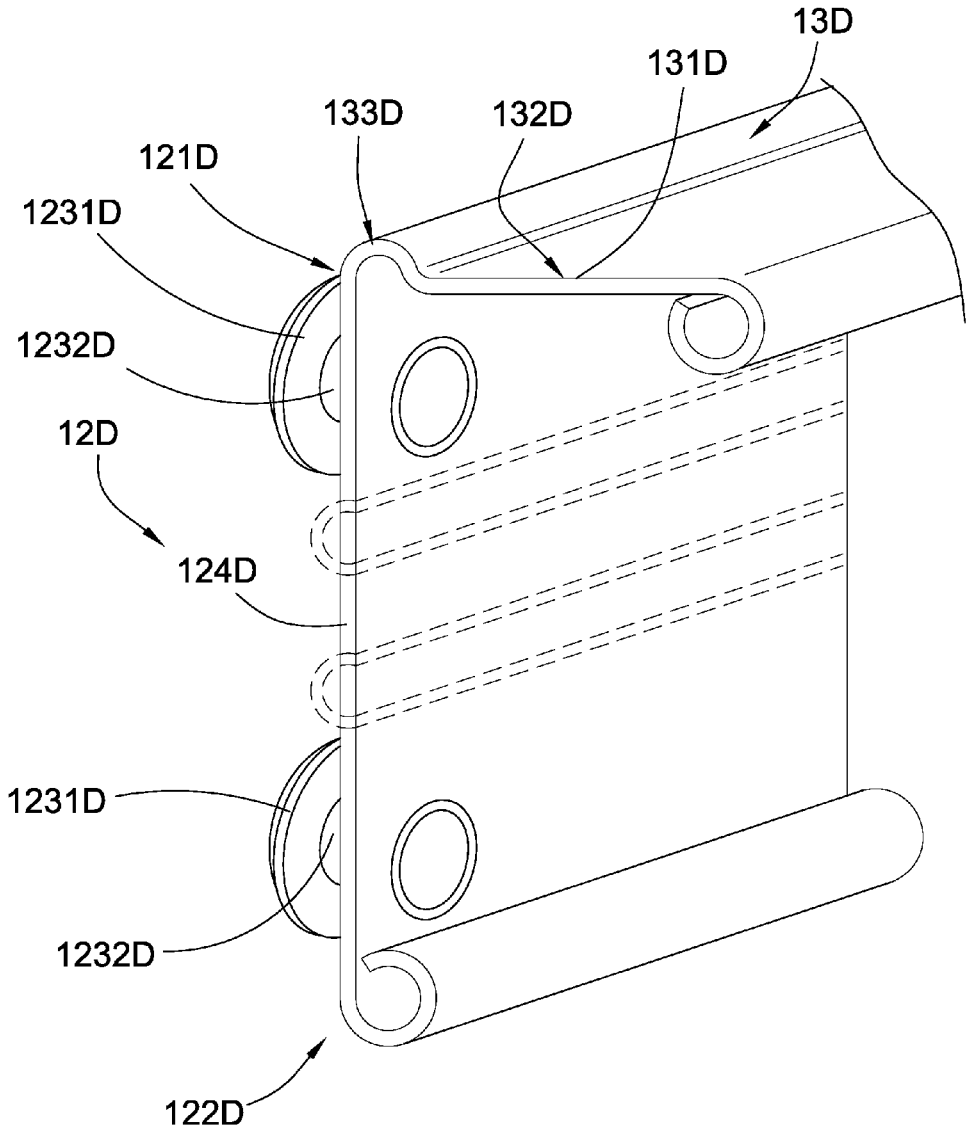
FIG. 12 is a perspective view of the shelf retaining member of the shelving apparatus according to the above second embodiment of the present invention.

As shown in FIGS. 12 and 13, each of the shelf retaining members 12D comprises a vertical beam wall 124D defining the first and second longitudinal edges 121D, 122D at the upper and bottom edges of the vertical beam wall 124D. In particular, the second longitudinal edge 122D of each of the shelf retaining members 12D is a folded edge that the bottom edge of the vertical beam wall 124D is inwardly folded on an inner side of the vertical beam wall 124D. Accordingly, the second longitudinal edge 122D of each of the shelf retaining members 12D has a circular cross sectional configuration.

The shelf supporting arrangement 13D comprises a top beam wall 131D integrally and horizontally extended from the upper edge of the vertical beam wall 124D to define a supporting surface 132D on the top beam wall 131D close to the first longitudinal edge 121D of the shelf retaining member 12D. The supporting surface 132D is an elongated flat surface to support the shelf platform 11D. Furthermore, a free edge of the top beam wall 131D is also a folded edge that the free edge of the top beam wall 131D is downwardly folded on a bottom side of the top beam wall 131D. Accordingly, the free edge of the top beam wall 131D has a circular cross sectional configuration.

The shelf supporting arrangement 13D further has a longitudinal reinforcing rib 133D integrally extended between the first longitudinal edge 121D of the shelf retaining member 12D and the top beam wall 131D. Accordingly, the longitudinal reinforcing rib 133D has a curved or arc-shaped cross sectional configuration that the longitudinal reinforcing rib 133D is extended between the upper edge of the vertical beam wall 124D and the top beam wall 131D. It is worth mentioning that the second longitudinal edge 122D of the shelf retaining member 12D, the free end of the top beam wall 131D, and the longitudinal reinforcing rib 133D is formed in curved cross sectional configuration to reinforce the structure of the shelf retaining member 12D to prevent any twisting movement or torque created thereat. In other words, when the downward loading force is applied on the supporting surface 132D of the top beam wall 131D, the longitudinal reinforcing rib 133D will prevent any twisting movement of the top beam wall 131D and will evenly transfer the downward loading force to the vertical beam wall 124D. Since the vertical beam wall 124D is coupled between two posts 20, the downward loading force will then transfer to the posts 20 via the vertical beam wall 124D so as to prevent any twisting movement of the vertical beam wall 124D.

As shown in FIG. 12, one or more of additional longitudinal reinforcing rib can be integrally and outwardly formed at the vertical beam wall 124D. Preferably, two additional longitudinal reinforcing ribs are extended in parallel, wherein each of the additional longitudinal reinforcing ribs has a curved cross section integrally bent at a mid-portion of the vertical beam wall 124D to reinforce the structure of the vertical beam wall 124D to prevent any twisting movement or torque created thereat.

It is appreciated that, as shown in FIGS. 12 to 13, when the shelf platform 11D sits on the supporting surface 132D, the downward force applied on the supporting surface 132D is supported and held by the top beam wall 131D which is further reinforced by the reinforcing ribs 133D and the additional reinforcing ribs that not only prevent the beam wall from being bent and deformed, but also provide better supporting ability to the top beam wall 131D and the supporting surface 132D. It is worth mentioning that two ends of the shelf retaining member 12D are coupled at two of the posts 20D respectively, such that the longitudinal reinforcing ribs 133D will generate an anti-twist reinforcing force to reinforce the planar structure of the vertical beam wall 124D so as to prevent any twisting force created thereat. In addition, when the downward force is applied on the supporting surface 132D, the downward force will transfer to the vertical beam wall 124D. Therefore, the reinforcing force from the reinforcing rib 133D will withstand the downward force at the vertical beam wall 124D. In other words, the reinforcing ribs 133D will also reinforce the downward force applied on the supporting surface 132D.

Furthermore, by configuring the longitudinal reinforcing rib 133D to have a curved cross section outwardly extended from the vertical beam wall 124D, the longitudinal reinforcing rib 133D will also generate a resilient force at the curved portion thereof. The direction of the resilient force of the longitudinal reinforcing rib 133D is opposite to the downward force applied on the supporting surface 132D, such that the longitudinal reinforcing rib 133D will also enhance the supporting ability of the supporting surface 132D to support a heavier load thereon.

It is worth mentioning that the shelf platform 11D of the supporting frame 10D is reversibly supported by the supporting surface 132D at a first position and a reversibly second position to selectively adjust a depth of the shelf platform 11D. At the first position, the base panel 112D of the shelf platform 11D is supported by the supporting surface 132D at a position that the surrounding edge 111D of the shelf platform 11D is located above the base panel 112D thereof to maximize the depth of the shelf platform 11D. At the second position, the base panel 112D of the shelf platform 11D is supported by the supporting surface 132D at a position that the surrounding edge 111D of the shelf platform 11D is located below the base panel 112D thereof to minimize the depth of the shelf platform 11D.

One skilled in the art will understand that the embodiment of the present invention as shown in the drawings and described above is exemplary only and not intended to be limiting.

It will thus be seen that the objects of the present invention have been fully and effectively accomplished. The embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A shelf supporting beam configuration for a shelving apparatus which comprises a plurality of vertically extending posts, comprising:

a shelf platform having a base panel and a surrounding edge defining a cavity within said surrounding edge and said base panel;

a plurality of shelf retaining members for detachably coupling with two of said posts to form a boundary frame to support said shelf platform therewithin, wherein each of said shelf retaining member has two coupling ends for detachably coupling with two of said posts in said unfolded condition, and first and second longitudinal edges extended between said two coupling ends, wherein each of said shelf retaining members provides a supporting surface extended from an inner side thereof between said two longitudinal edges to support said respective shelf platform and at least one longitudinal edge portion of each of said shelf retaining members is inwardly folded on an inner side thereof to form said longitudinal edge to reinforce a planar configuration of said retaining member, wherein each of said shelf retaining members has a plurality of supporting tabs horizontally aligned with each other and protruded from said inner side of each of said shelf retaining members between first and second longitudinal edges thereof and defines a plurality of discrete supporting surfaces on said supporting tabs to support said shelf platform thereon, wherein each of said supporting tabs has a triangular shape defining a peak pointing toward said second longitudinal edge of said shelf retaining member and a flat surface as said supporting surface facing toward said first longitudinal edge of said shelf retaining member, wherein said discrete supporting surfaces are aligned with each other at a same planar direction to form a flat support for supporting said shelf platform;

a shelf supporting arrangement integrally extended from each of said shelf retaining members between said first and second longitudinal edges to support said shelf platform within said boundary frame, wherein said shelf platform is able to be selectively supported by said shelf supporting arrangement with said surrounding edge located below base panel and said cavity facing downward or said surrounding edge located above said base panel and said cavity facing upward.

2. The shelf supporting beam configuration, as recited in claim 1, wherein each of said supporting tabs is integrally bent from said inner side of said shelf retaining member to define said supporting surface close to said first longitudinal edge of said shelf retaining member.

3. A shelf supporting beam configuration for a shelving apparatus which comprises a plurality of vertically extending posts, comprising:

a shelf platform having a base panel and a surrounding edge defining a cavity within said surrounding edge and said base panel;

a plurality of shelf retaining members for detachably coupling with two of said posts to form a boundary frame to support said shelf platform therewithin, wherein each of said shelf retaining member has two coupling ends for detachably coupling with two of said posts in said unfolded condition, and first and second longitudinal edges extended between said two coupling ends, wherein each of said shelf retaining members provides a supporting surface extended from an inner side thereof between said two longitudinal edges to support said respective shelf platform and at least one longitudinal edge portion of each of said shelf retaining members is inwardly folded on an inner side thereof to form said longitudinal edge to reinforce a planar configuration of said retaining member, wherein each of said shelf retaining members has a plurality of first and second supporting tabs horizontally aligned with each other and protruded from an inner side of said shelf retaining member between said first and second longitudinal edges thereof and defines a plurality of discrete first and second supporting surfaces on said supporting tabs, wherein said first supporting tabs are alternated with said second supporting tabs, such that said shelf platform is selectively supported by said first supporting surfaces or said second supporting surfaces;

a shelf supporting arrangement integrally extended from each of said shelf retaining members between said first and second longitudinal edges to support said shelf platform within said boundary frame, wherein said shelf platform is able to be selectively supported by said shelf supporting arrangement with said surrounding edge located below base panel and said cavity facing downward or said surrounding edge located above said base panel and said cavity facing upward.

4. The shelf supporting beam configuration, as recited in claim 3, wherein a distance between said first longitudinal edge and said first supporting surfaces is smaller than a distance between said second longitudinal edge and said second supporting surfaces.

5. The shelving apparatus, as recited in claim 3, wherein each of said shelf retaining members is reversible for coupling to the posts between a first position and a second position, wherein at said first position, said first supporting surface is located above said second supporting surface to support said shelf platform, and at said second position, said second supporting surface is located above said first supporting surface to support said shelf platform.

6. The shelving apparatus, as recited in claim 4, wherein each of said shelf retaining members is reversible for coupling to the posts between a first position and a second position, wherein at said first position, said first supporting surface is located above said second supporting surface to support said shelf platform, and at said second position, said second supporting surface is located above said first supporting surface to support said shelf platform.

7. The shelf supporting beam configuration, as recited in claim 4, wherein each of said first supporting tabs has a triangular shape defining a peak pointing toward said second longitudinal edge of said shelf retaining member and a flat surface as said first supporting surface facing toward said first longitudinal edge of said shelf retaining member, wherein said discrete first supporting surfaces are aligned with each other at a same planar direction to form a flat support for supporting said shelf platform, wherein each of said second supporting tabs has a triangular shape defining a peak pointing toward said first longitudinal edge of said shelf retaining member and a flat surface as said second supporting surface facing toward said second longitudinal edge of said shelf retaining member, wherein said discrete second supporting surfaces are aligned with each other at a same planar direction to form a flat support for supporting said shelf platform when each of said shelf retaining members reversed for being coupled to said posts.

8. The shelf supporting beam configuration, as recited in claim 6, wherein each of said first supporting tabs has a triangular shape defining a peak pointing toward said second longitudinal edge of said shelf retaining member and a flat surface as said first supporting surface facing toward said first longitudinal edge of said shelf retaining member, wherein said discrete first supporting surfaces are aligned with each other at a same planar direction to form a flat support for supporting said shelf platform, wherein each of said second supporting tabs has a triangular shape defining a peak pointing toward said first longitudinal edge of said shelf retaining member and a flat surface as said second supporting surface facing toward said second longitudinal edge of said shelf retaining member, wherein said discrete second supporting surfaces are aligned with each other at a same planar direction to form a flat support for supporting said shelf platform when each of said shelf retaining members reversed for being coupled to said posts.

* * * * *